US008974076B2

(12) United States Patent
Gergen

(10) Patent No.: US 8,974,076 B2
(45) Date of Patent: Mar. 10, 2015

(54) ARTISTIC LIGHTING APPARATUS WITH CYLINDRICAL GOBOS

(71) Applicant: Judy Gergen, Lincoln, NE (US)

(72) Inventor: Judy Gergen, Lincoln, NE (US)

( * ) Notice: Subject to any disclaimer, the term of this patent is extended or adjusted under 35 U.S.C. 154(b) by 72 days.

(21) Appl. No.: 13/856,957

(22) Filed: Apr. 4, 2013

(65) Prior Publication Data

US 2013/0223051 A1 Aug. 29, 2013

Related U.S. Application Data

(63) Continuation-in-part of application No. 13/044,371, filed on Mar. 9, 2011, now Pat. No. 8,414,143.

(51) Int. Cl.

| | |
|---|---|
| ***F21V 1/10*** | (2006.01) |
| ***F21S 10/00*** | (2006.01) |
| *F21S 10/02* | (2006.01) |
| *F21Y 101/02* | (2006.01) |
| *F21Y 113/00* | (2006.01) |

(52) U.S. Cl.

CPC ..... *F21V 1/10* (2013.01); *F21S 10/007* (2013.01); *F21S 10/02* (2013.01); *F21Y 2101/02* (2013.01); *F21Y 2113/005* (2013.01)

USPC ..... 362/217.02; 362/286

(58) Field of Classification Search

USPC ..... 362/232, 272, 286, 217.02

See application file for complete search history.

(56) References Cited

U.S. PATENT DOCUMENTS

| | | | | |
|---|---|---|---|---|
| 4,602,321 | A | 7/1986 | Bornhorst | |
| 5,402,326 | A | 3/1995 | Belliveau | |
| 6,113,252 | A | 9/2000 | Arlitt et al. | |
| 6,220,730 | B1 | 4/2001 | Hewlett et al. | |
| 7,148,497 | B2 * | 12/2006 | Gardner | 250/503.1 |
| 7,748,869 | B2 | 7/2010 | Sevack et al. | |
| 2002/0047646 | A1 * | 4/2002 | Lys et al. | 315/312 |
| 2002/0075685 | A1 | 6/2002 | Rasmussen et al. | |
| 2004/0001341 | A1 * | 1/2004 | Chang et al. | 362/260 |

* cited by examiner

*Primary Examiner* — Tracie Y Green

(74) *Attorney, Agent, or Firm* — Suiter Swantz pc llo

(57) ABSTRACT

A device for creating and enhancing a mood is disclosed. The device includes a cylindrical gobo with a light source and a motor to rotate the gobo. The device may also include color-changing LEDs. Through variations in color, light source intensity and gobo design, a user may create or enhance a desired mood in a room.

20 Claims, 3 Drawing Sheets

ARTISTIC LIGHTING APPARATUS WITH CYLINDRICAL GOBOS

PRIORITY

The present application claims the benefit under 35 U.S.C. §120 as a continuation-in-part of U.S. patent application Ser. No. 13/044,371, filed Mar. 9, 2011, now U.S. Pat. No. 8,414,143, issued Apr. 9, 2013, which is incorporated herein by reference.

TECHNICAL FIELD

This disclosure relates to lighting systems, and particularly to artistic lighting systems for creating or enhancing a particular mood.

BACKGROUND AND PRIOR ART

Artistic lighting can create and enhance a particular mood in a particular environment. In the case of a single room, artistic lighting choices such as lighting color and intensity can create an atmosphere of calm, excitement, romance, etc.

One particular artistic lighting device is a gobo. A gobo (go between) is traditionally a metal disk with patterns cut out to let light pass through. A gobo is put into a holder and then placed in between a light source and a surface onto which the pattern is to be projected. Gobos create stationary projections, but cannot create the impression of a dynamic environment.

SUMMARY

The present invention is an apparatus for providing dynamic, artistic lighting to a room. The apparatus comprises a cylindrical gobo functionally connected to a motor for rotating the cylindrical gobo. Light from a light source in the center of the cylindrical gobo passes through patterned openings in the gobo to form projected images on a surface.

The apparatus may also have color changing LEDs to further alter and enhance the effect created by the projected light patterns from the cylindrical gobo. Multiple devices may be connected together to project light patterns on a larger surface.

DETAILED DESCRIPTION

Reference will now be made in detail to the subject matter disclosed, which is illustrated in the accompanying drawings. The scope of the invention is limited only by the claims; numerous alternatives, modifications and equivalents are encompassed. For the purpose of clarity, technical material that is known in the technical fields related to the embodiments has not been described in detail to avoid unnecessarily obscuring the description.

Figure 1:
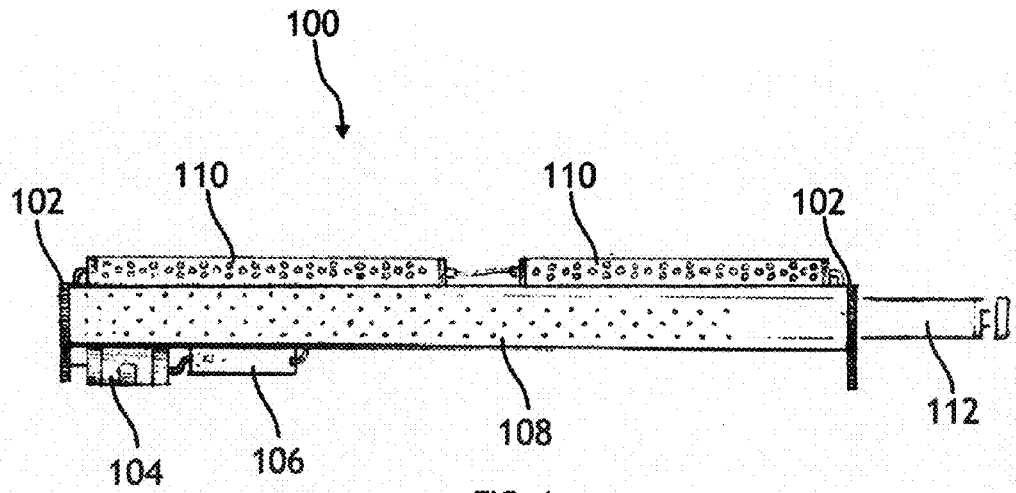
FIG. 1 shows a top sectional view of one embodiment of the present invention.

Referring to FIG. 1, one embodiment of an artistic lighting apparatus 100 according to the present invention includes a cylindrical gobo 108. A gobo is a device known in the art for creating projected light patterns. Gobos are generally thin metallic structures with patterns cut into the surface to allow light to pass through. A user places a gobo between a light source and a surface onto which the user wishes the pattern projected. Gobos known in the art are flat metallic disks held in gobo holders. In the present invention, the cylindrical gobo 108 may be a metallic surface with patterns cut through the surface to allow light from a light source to pass through. The artistic lighting apparatus 100 may include an elongated light source 112 inside the cylindrical gobo 108, such as a fluorescent tube or some other light emitting structure capable of illuminating the entire interior length of the cylindrical gobo 108 and projecting light onto a surface. The artistic lighting apparatus 100 may include a gobo rotating motor 104. The gobo rotating motor 104 may be connected to one or more gobo rotating gears 102, also connected to the cylindrical gobo 108. The gobo rotating motor 104 may turn the gobo rotating gears 102, and thereby turn the cylindrical gobo 108 about an axis defined by a centerline of the cylindrical gobo 108. The artistic lighting apparatus 100 may include one or more color-changing LED lamps 110, known in the art. Color-changing LED lamps 110 may project colored, unpatterned light onto a surface while the elongated light source 112 emits light through the cylindrical gobo 108 to project patterned light onto the same surface. The artistic lighting apparatus 100 may include a display control computer 106, functionally connected to the gobo rotating motor 104, the color-changing LED lamps 110 and the elongated light source 112. The display control computer 106 may be programmed to operate the gobo rotating motor 104, color-changing LED lamps 110 and elongated light source 112 according to a predetermined program. The display control computer may vary the speed of rotating of the cylindrical gobo 108 by varying the speed of rotation of the gobo rotating motor 104; it may vary the color and intensity of the color changing LED lamps 110; and it may vary the intensity of the elongated light source 112. Furthermore, the display control computer 106 may include sound generation functionality to produce a signal for generating sound. Sound may be played through to an attached speaker, or the signal may be sent to a separate sound system. The display control computer 106 may store one or more pre-loaded sound files, or may be connected to a computer to receive and store sound files. The display control computer 106 may include some algorithm for applying changes to light and rotation according to aspects of a sound feature.

Figure 2:
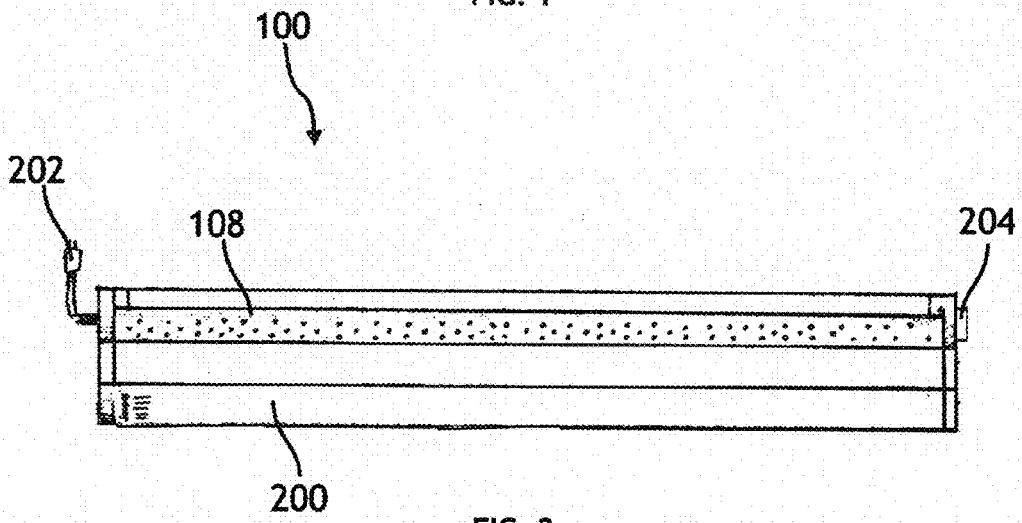
FIG. 2 shows a top view of the embodiment shown in FIG. 1.
Figure 3:
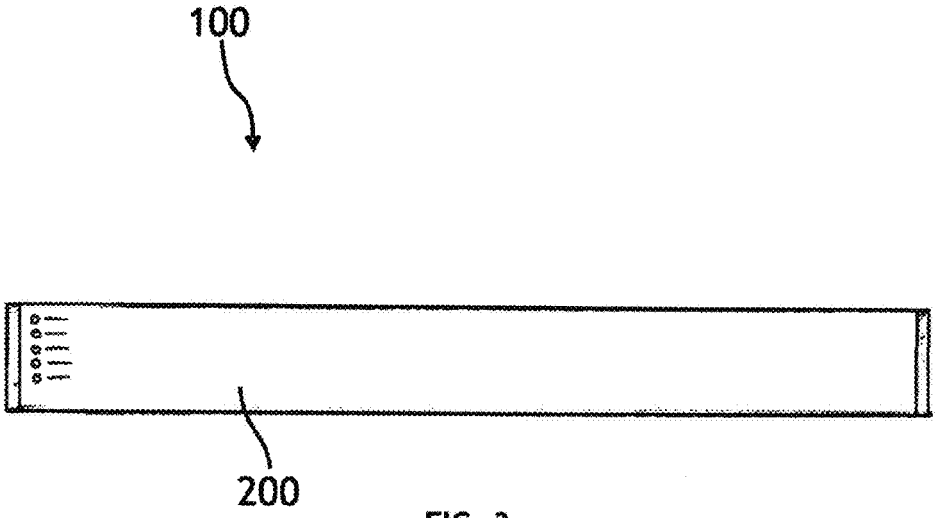
FIG. 3 shows a rear view of the embodiment shown in FIG. 1.

Referring to FIG. 2 and FIG. 3, the artistic lighting apparatus 100 may further include light obstructive housing 200 to define a direction for light emitted from the artistic lighting apparatus 100 to project onto a surface. The light obstructive housing 200 obstructs allows the user to position the artistic lighting apparatus 100 such that light may be projected onto a single surface and obscured form all other surfaces. The light obstructive housing 200 also provides a structure for mounting the gobo rotating motor 104 and the gobo rotating gears 102. The light obstructive housing 200 also supports the cylindrical gobo 108, because the cylindrical gobo 108 would be functionally connected to the gobo rotating gears 102. The light obstructive housing 200 may also provide a housing for the color-changing LED lamps 110, and support for the elongated light source 112. The artistic lighting apparatus 100 may include a power input connector 202 such as a power cord, functionally connected to the display control computer 106, and may include a pass-through power output connector 204 to connect a second artistic lighting apparatus.

Figure 4:
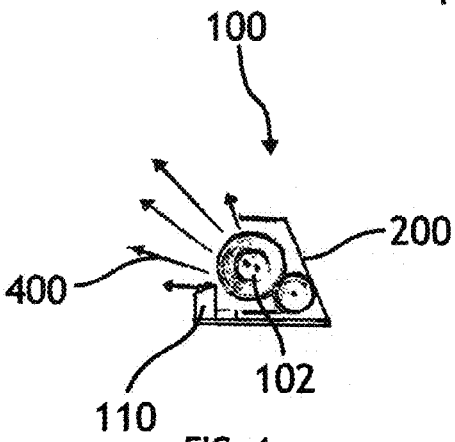
FIG. 4 shows a side sectional view of the embodiment shown in FIG. 1.
Figure 5:
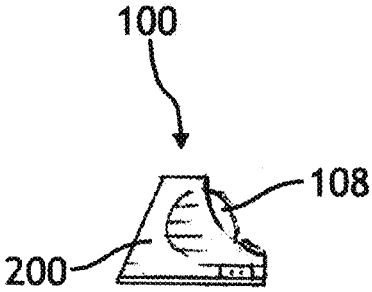
FIG. 5 shows a side view of the embodiment shown in FIG. 1.

Referring to FIG. 4 and FIG. 5, the figures show a sectional view and side view of the artistic lighting apparatus 100 in operation. The light obstructive housing 200 obstructs light emanating from the elongated light source 112 and the color-changing LED lamps 110 except where the user has oriented the artistic lighting apparatus 100 to direct such light 400 toward a particular surface. The light obstructive housing allows the user to create a particular artistic affect, and contain the affect to a defined area.

Figure 6:
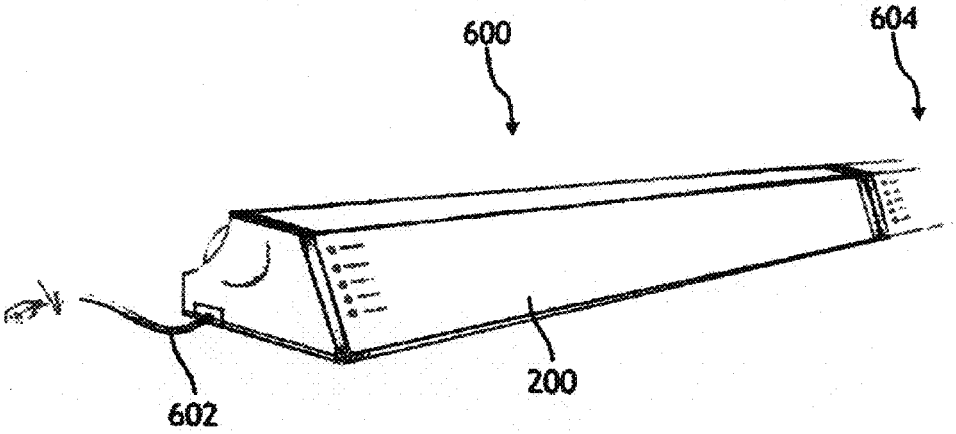
FIG. 6 shows a perspective view of the embodiment shown in FIG. 1.

Referring to FIG. 6, in another embodiment, a user may connect a first artistic lighting apparatus 600 to an identical second artistic lighting apparatus 604. In this embodiment, the first artistic lighting apparatus 600 may include a detachable power cord 602. The detachable power cord 602 would be detached from the second artistic lighting apparatus 604. The first artistic lighting apparatus may have a pass-through power output connector 204 (not shown), that would engage a receptacle where the detachable power cord 602 would have been attached, and thereby provide power to the second artistic lighting apparatus 604.

Figure 7:
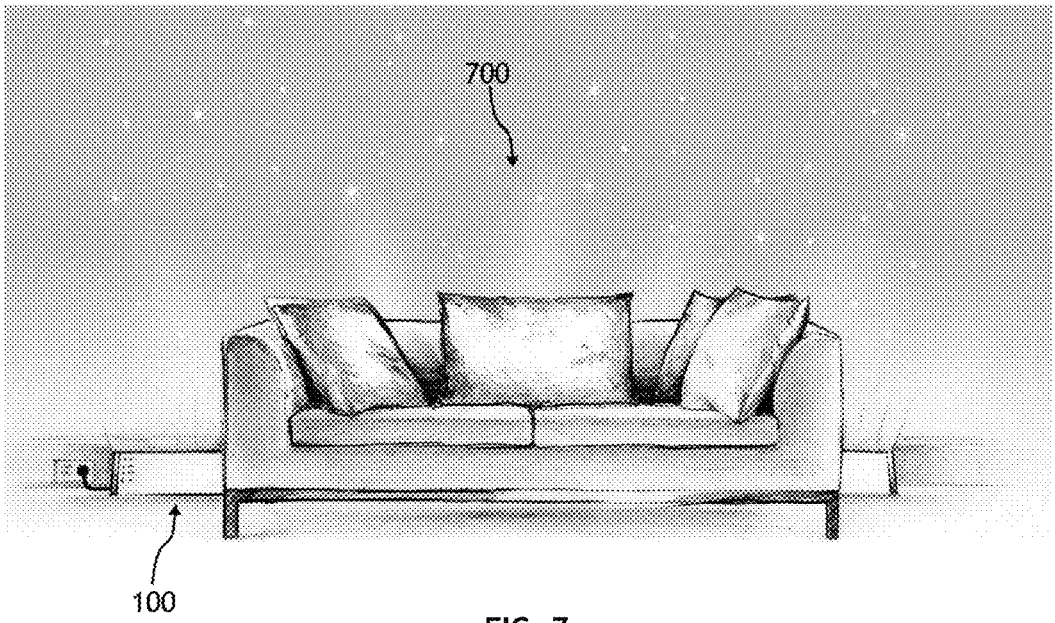
FIG. 7 shows an environmental view of the embodiment shown in FIG. 1.

Referring to FIG. 7, the artistic lighting apparatus 100 projects an artistic light display 700 onto a surface. The light display 700 may include various colors to create or enhance a particular mood. The light display may also change as the cylindrical gobo 108 rotates within the artistic lighting apparatus 100.

Although the disclosure has been described in terms of specific embodiments, one skilled in the art will recognized that various modifications may be made that are within the scope of the present disclosure. Therefore, the scope of the disclosure should not be limited to the foregoing description. Rather, the scope of the disclosure should be determined based upon the claims recited herein, including the full scope of equivalents thereof.

What is claimed is:

1. An lighting apparatus comprising:

a cylindrical gobo for applying an artistic pattern to light emitted from a light source;

an elongated light source for emitting light to pass through openings corresponding to the artistic pattern in the cylindrical gobo, the elongated light source disposed along an axis substantially defined by a centerline of the cylindrical gobo;

a gobo rotating motor for rotating the cylindrical gobo about the axis defined by the centerline of the cylindrical gobo, said axis configured to cause the openings to transit around the elongated light source as the cylindrical gobo rotates; and a power input connector for powering the elongated light source and the gobo rotating motor, functionally connected to the elongated light source and the gobo rotating motor.

2. The apparatus of claim 1, further comprising a display control computer configured to control the speed of rotation of the gobo rotating motor, functionally interposed between the power input connector and the gobo rotating motor.

3. The apparatus of claim 1, further comprising a display control computer configured to control the intensity of light emitted from the elongated light source, functionally interposed between the power input connector and the elongated light source.

4. The apparatus of claim 3, further comprising a display control computer configured to control the speed of rotation of the gobo rotating motor, functionally interposed between the power input connector and the gobo rotating motor.

5. The apparatus of claim 1, wherein the elongated light source further comprising one or more color-changing LED lamps.

6. The apparatus of claim 5, further comprising a display control computer configured to control the speed of rotation of the gobo rotating motor, functionally interposed between the power input connector and the gobo rotating motor.

7. The apparatus of claim 5, further comprising a display control computer configured to control the intensity of light emitted from the elongated light source, functionally interposed between the input power connector and the elongated light source.

8. The apparatus of claim 7, further comprising a display control computer configured to control the speed of rotation of the gobo rotating motor, functionally interposed between the power input connector and the gobo rotating motor.

9. A lighting apparatus comprising:

a cylindrical gobo comprising openings in the surface corresponding to an artistic pattern, configured to apply the artistic pattern to light emitted from a light source;

a gobo rotating motor for rotating the cylindrical gobo about an axis defined by a centerline of the cylindrical gobo, said axis configured to cause the openings in the surface to transit around the light source as the cylindrical gobo rotates;

a power input configured to power an elongated light source and the gobo rotating motor; and a display control computer configured to control the gobo rotating motor.

10. The apparatus of claim 9, wherein the display control computer is configured to control an intensity of light emitted from an elongated light source.

11. The apparatus of claim 9, wherein the display control computer is configured to control a plurality of color changing LED lamps.

12. The apparatus of claim 11, wherein the display control computer is further configured to store a predefined lighting display.

13. The apparatus of claim 12, wherein the predefined lighting display comprises applying at least two different rotational velocities to the gobo rotating motor at different times.

14. The apparatus of claim 12, wherein the predefined lighting display comprises applying at least two different illumination intensities to one or more of the plurality of color changing LED lamps at different times.

15. The apparatus of claim 9, wherein the display control computer is further configured to generate a signal configured to produce a sound.

16. The apparatus of claim 15, wherein the display control computer is further configured to:

control a plurality of color changing LED lamps; and alter at least one of a light intensity and a color of the color changing LED lamps based on the signal.

17. The apparatus of claim 16, wherein the display control computer is further configured to alter the rotation of the gobo rotating motor based on the signal.

18. A gobo apparatus comprising:

a cylindrical body configured to receive an elongated light source along an axis substantially defined by a centerline of the cylindrical body;

a plurality of artistic cutouts in the cylindrical body configured to apply a pattern to light emitted from the elongated light source along the axis substantially defined by the centerline of the cylindrical body; and a motor engaging element disposed on the cylindrical body, configured to engage a motor, wherein the motor engaging element is configured to allow the cylindrical body to rotate about the axis substantially defined by the centerline of the cylindrical body such that the artistic cutouts transit around the elongated light source when the cylindrical body rotates.

19. The gobo apparatus of claim 18, wherein the plurality of cutouts are configured to apply a shifting pattern to light based on a relative angle and distance of to a display surface as the cylindrical body rotates.

20. The gobo apparatus of claim 18, wherein the cylindrical body is configured to engage a second cylindrical body such that the second cylindrical body defines a centerline substantially coaxial to an axis defined by a centerline of the cylindrical body.

* * * * *